US006532747B2

(12) United States Patent
Kriz et al.

(10) Patent No.: US 6,532,747 B2
(45) Date of Patent: Mar. 18, 2003

(54) DEVICE AND METHOD FOR PERFORMING A PROCESS IN A PROCESS MEDIUM

(75) Inventors: Dario Kriz, Hoor (SE); Christer Ljung, Landskrona (SE)

(73) Assignee: AB Implementa Hebe, Lund (SE)

( * ) Notice: Subject to any disclaimer, the term of this patent is extended or adjusted under 35 U.S.C. 154(b) by 0 days.

(21) Appl. No.: 10/072,405

(22) Filed: Feb. 8, 2002

(65) Prior Publication Data

US 2003/0000224 A1 Jan. 2, 2003

(30) Foreign Application Priority Data

Jun. 27, 2001 (SE) ..... 0102280

(51) Int. Cl.[7] ..... F25B 21/02
(52) U.S. Cl. ..... 62/3.7; 62/376
(58) Field of Search ..... 62/3.1, 3.2, 3.3, 62/3.7, 156, 158, 211, 376

(56) References Cited

U.S. PATENT DOCUMENTS 6,171,850 B1 * 1/2001 Nagle et al. ..... 435/286.1
6,337,212 B1 * 1/2002 Nagle et al. ..... 436/174

* cited by examiner

*Primary Examiner*—Denise L. Esquivel
*Assistant Examiner*—Melvin Jones
(74) *Attorney, Agent, or Firm*—Knobbe Martens Olson & Bear LLP

(57) ABSTRACT

The present invention relates to a device in performing a process in a process medium by varying the parameters of said process medium over time in a laboratory scale, according to a predetermined scheme. The device comprises at least one reaction receptacle, a heat transfer plate, a peltiere element, a temper sensor, a magnetic stirrer and a data processing unit. The data processing unit is adapted to send out signals to the peltiere element in response to incoming signals from the temperature sensor. The invention further relates to a method for controlling the data processing unit.

17 Claims, 3 Drawing Sheets

DEVICE AND METHOD FOR PERFORMING A PROCESS IN A PROCESS MEDIUM

BACKGROUND OF THE INVENTION

1. Field of the Invention

The present invention relates to a device used in performing a process in a process medium by varying the parameters of said process medium, and more particularly, a device for controlling a temperature change of a process medium during the process.

2. Description of the Related Art

Chemists working in a laboratory scale within different areas need means to control and accurately follow reactions in a process medium, for example, a solution. Ordinary means of decreasing the temperature in, for example, a solution has been to place the beaker containing the solution, wherein reactions are taking place, in an ice-bath, for example, thereby causing the temperature to be lowered. This does lead to a temperature decrease. However, it is not possible to follow the reactions, for example a crystallization of the solution, accurately and precisely. It is also difficult in these cases in a laboratory scale to obtain results which can be reproduced. In certain research areas, there would be considerable advantages if the chemist could accurately and precisely follow a reaction over time.

In the Swedish patent SE 9203388-5, a device for keeping the temperature constant in a solution in a laboratory scale is described, said device being characterized by that of a cooling unit comprising a peltiere element that has been combined with a magnetic stirrer.

Within the art, there is a considerable need of a device for controlling processes accurately in a laboratory scale.

SUMMARY OF THE INVENTION

The present invention relates in one aspect to a device in performing a process in a process medium by varying the parameters of said process medium over time in a laboratory scale, according to a predetermined scheme, said device comprising at least one reaction receptacle, cooling/heating means comprising at least one peltiere element, parameter-sensing means, stirring means and a data processing unit, said data processing unit 26 being adapted to send out signals to said peltiere element in response to incoming signals from said parameter-sensing means.

The invention in another aspect relates to a computer program product comprising a computer program for controlling a data processing unit, said computer program, when processed, performing the steps: (i) from a parameter-sensing means receiving an input signal having information on the parameters of a process medium; (ii) processing the input signal by comparing said signal with a predetermined scheme value; (iii) and, if a difference compared to the predetermined scheme value is registered, sending a first output signal to a peltiere element.

Another embodiment of the invention is a device for controlling the temperature change in a reaction receptacle according to a predetermined scheme. The device includes a reaction receptacle containing a magnetic stirrer, a heat transfer plate in contact with said reaction receptacle, a peltiere element in contact with said heat transfer plate, at least one temperature sensor, a cooling flange comprising a motor, wherein a magnetic is attached to said motor such that said influences the magnetic stirrer in the receptacle, and a data processing unit adapted to send out signals to the peltiere element in response to incoming signals from the temperature sensor.

Another embodiment of the invention is a method of controlling the temperature in a reaction receptacle using a data processing unit. The method includes entering a desired temperature for a solution in a reaction receptacle, receiving an input signal from a temperature sensor related to the actual temperature of the solution in the reaction receptacle, comparing the actual temperature with the desired temperature, and sending a first output signal to a peltiere element if a difference is registered between the actual temperature and the desired temperature, wherein said first output signal causes the peltiere element to heat or cool the solution until the actual temperature is substantially equal to the desired temperature.

BRIEF DESCRIPTION OF THE DRAWINGS

These and other objects and features of the invention will become more fully apparent from the following description and appended claims taken in conjunction with the following drawings, where like reference numbers indicate identical or functionally similar elements.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is intended to be interpreted in its broadest reasonable manner in accordance with its ordinary use in the art and in accordance with any overt definitions provided below.

Figure 1:
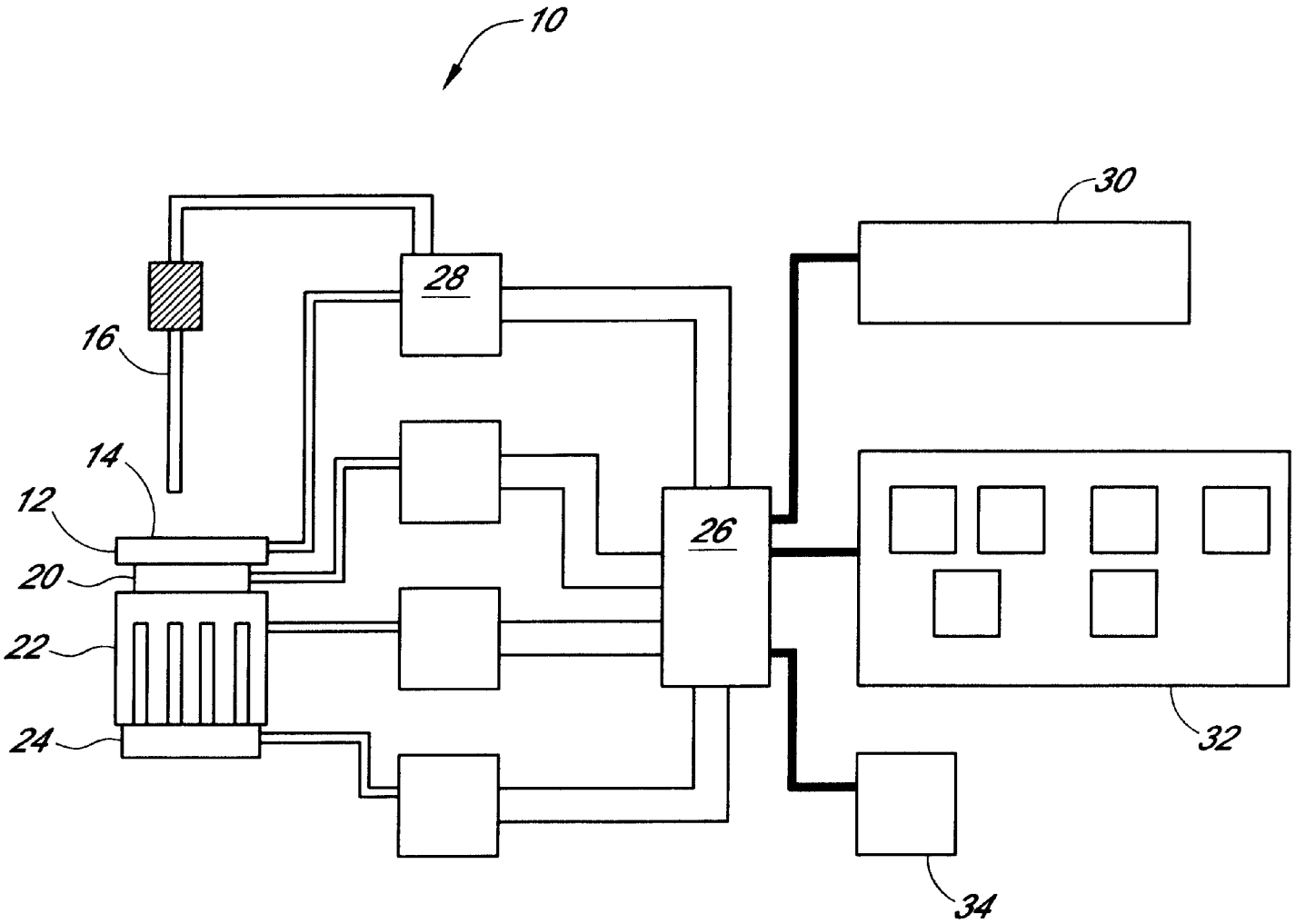
FIG. 1 illustrates a drawing of a device according to the present invention.

FIG. 1 illustrates a device for accurately controlling the temperature of a solution during a process. Preferably, the device 10 enables a user to repeatedly reproduce the same results due to the precise control of the parameters of the process medium. The device 10 contains a heat transfer plate 12. The heat transfer plate 12 is a plate capable of transferring heat or cold, and is preferably a metal plate, and more preferably a gilded brass plate. The plate 12 contains an internal digital temperature sensor 14 (such as model no. DS1820, available from Dallas Inc., USA). An upper side of the plate 12 is intended to be in contact with a bottom surface of a reaction receptacle (not shown), such as a beaker containing a sample solution. A lower side of the plate 12 is in contact with a peltiere element 20. In the present disclosure, the expression reaction receptacle is meant to include any kind of vessel suited for the desirable heating or cooling transfer from the peltiere element 20 via the plate 12 to the receptacle containing the solution. The peltiere element 20 is also in contact with a cooling flange 22 containing a centrally provided motor, on the axis of which a magnetic stirrer is fixed. The polarity of the current flowing through the peltiere element 20 used in the device 10 according to the invention may be changed, causing both heat and cold to be generated.

A fan 24 is located below the cooling flange 22. A data processing unit 26 (such as the Basic Stamp 2, available from Parallax Inc., USA) regulates various functions, such as: activating the peltiere element 20 to either heat or cool the plate 12, thereby tempering the solution within the beaker; activating the fan 24 to pass away the cold or heat generated by the cooling flange 22 and the peltiere element 20; regulating the number of revolutions (rpm) of the motor and thereby also the rpm of said magnet causing the rpm of the magnetic stirrer located in said beaker to be adjusted.

A support unit 28 (such as model no. PIC12C671, available from Microchip Inc., USA) collects data from an external digital temperature sensor (such as model no. DS1820, available from Dallas Inc., USA) which provides an additional, and preferably, a better illustration of the actual temperature of the solution compared to if only the internal digital temperature sensor 14 is used. The support unit 28 mediates only temperature data from the external temperature sensor 16 if it is connected, otherwise the temperature data of the internal digital temperature sensor 14 is mediated to the data processing unit 26. If the support unit 28 registers that the temperature of the plate 12 is greater than the maximum allowed values according to the manufacturer of the peltiere element 20, a signal is sent to the data processing unit 26.

The data processing unit 26 presents the actual settings and values on a display 30. Parameters such as start and stop temperature value, size of the temperature variation over time, and stirring rate are entered on a keyboard 32 and then a computer program in the data processing unit 26 is responsible to enable the device 10 to achieve the adjusted values. The data processing unit 26 can collect or send information to a network or other computer by way of a serial interface 34.

In one embodiment of the invention, the data processing unit 26 stores information as to the appropriate variation of the parameters over time, such as a predetermined scheme.

In a further embodiment of the invention, the internal digital temperature sensor 14 or the external temperature sensor are immersed in the process medium. The internal digital temperature sensor 14 may be a part of the plate 12.

In another embodiment of the invention, the peltiere element 20, in response to the output signal from the data processing unit 26 is adapted to heat or cool the metal plate 12, with which it is in contact. In another embodiment, one side of said peltiere element 20 is in contact with the plate 12 and the other side is in contact with the cooling flange 22.

In a further embodiment of the invention, the computer program, when processed, further performs the step of sending a second output signal to the fan 24.

In still a further embodiment of the invention, the computer program, when processed, further sends a third output signal to a motor controlling the number of revolutions of the magnetic stirrer.

In another embodiment of the invention, the data processing unit 26 further comprises units such as a program memory, a working memory and a processor.

The predetermined scheme according to which the parameters, preferably the temperature, of the solution are to follow is set by a user. The predetermined scheme usually contains a start value and a stop value. The rate at which the parameters of the solution, preferably the temperature, are to increase or decrease from the start value and stop value, respectively, over time is also determined by the user and depending naturally on the conditions of the chemical process. The parameters of the solution, preferably the temperature, will follow the predetermined scheme in response to the output signals from the data processing unit 26 in turn responding to the input signals from the temperature-sensing means. The user desiring to follow and observe the accuracy of a chemical process will set both a start set value, a stop set value and a rate (°C./min) at which the chemical process is to follow from the start set value to the stop set value. The rate (°C./min) may be rising or falling from the start value to the stop set value and depends on the conditions of the chemical process. Thus, the predetermined scheme can be regarded as the temperature as a function of time.

In the present disclosure, the expression "real value" means the actual value obtained in the process, i.e., the real temperature of the process medium measured with temperature-sensing means.

The variation of the temperature over time may be in the interval from 0.001° C./minute to 10° C./minute, or more, depending naturally on the process the user wants to follow.

Another embodiment of the invention is a method to vary the temperature of the solution. In a first step, the temperature of a solution is measured by a temperature-sensing means and sending an input signal, real value, to the data processing unit 26. The data processing unit 26 compares the input signal with the predetermined scheme, set value. If there is a difference between real value and set value, the data processing unit 26 sends an output signal to the peltiere element 20, whereby the peltiere element 20 in response to the output signal heats or cools the metal plate 12, with which it is in contact. The plate 12 being heated or cooled in the previous step above is directly or indirectly in contact with the reaction receptacle containing the solution. The fan 24 may also be activated by an output signal from the data processing unit 26 in order to conduct away the heat or cold generated. Stirring means may also be regulated in response to an output signal from the data processing unit 26 in order to either increase or decrease the number of revolutions of the magnetic stirrer.

In one embodiment of the invention, one side of the peltiere element 20 is in contact with the plate 12 and the other side is in contact with the cooling flange 22, whereby the cooling flange 22 is in contact with a fan 24. The fan 24 is intended to be used for passing away generated heat or cold from the peltiere element 20 and cooling flange 22, respectively.

In some sensitive chemical reactions, the temperature variation needs to be controlled very accurately whereby the stirring of the solution is important and is effected with the magnetic stirrer. The stirrer allows the solution to have a substantially homogeneous temperature.

The variation of the temperature over time in the solution can be an increase or decrease of the temperature within the range of 0.001–10° C./min., or more. The chosen variation over time depends on the chemical reaction and on the different conditions.

Different applications of the device 10 according to the present invention include, but are not necessarily limited to, crystallization and precipitation of inorganic materials, organic polymers and biochemical substances, enantiomeric selective precipitation of a D-form or L-form of an enantiomer of a substance, selective dissolution at different temperatures of components in a substance in order to remove undesirable agents, controlled and delicate dissolution of temperature-sensitive substances in need of heating in connection with dissolution, controlled and delicate melting of inorganic, organic and biochemical substances. Other applications within the field of biotechnology include, but are not necessarily limited to, controlled temperature cycling of enzymatic reactions, controlled temperature cycling of DNA or RNA hybridization reactions, kinetic studies of the effect of the temperature on chemical reactions, enzymatic reactions, complex formation reactions and DNA/RNA hybridization reactions, temperature regulation of chemical and enzymatic reactions by reactants or products which may be activated or deactivated by a controlled temperature change of the reaction mixture. The device 10 according to the invention may be used in any other application, wherein the control of the temperature is needed and is of substantial value.

The computer program stored in the memory media controls at least the following functions of the device 10: the size of the variation of the temperature over time, start and stop temperature set value, regulation of the starting of the electrical fan 24, overheating control of the peltiere element 20 and control of the rpm of the magnetic stirrer.

Further, the computer program follows the actual temperature of the process medium measured by the temperature-sensing means as a function of time and controls the starting of and polarity of the peltiere element 20. The control occurs so that the process medium is cooled or heated depending on if its temperature differs from the predetermined temperature scheme which is to be maintained from the start temperature set value to the stop set temperature value.

The device 10 according to the invention has many advantages in a laboratory scale. By varying the temperature over time accurately in a process medium containing different chemical species, it is possible to obtain a selective dissolution of each species present. This is an important tool, for example, when impurities are to be removed.

Another important advantage obtained is in connection with chemical, biological or enzymatic reactions where reactants or products may be activated or deactivated by a controlled temperature change of the reaction mixture used on the device 10 according to the present invention.

A further advantage is the increased yield of a substance such as crystals that may be obtained by the precise control of the parameters by the device 10 of the invention.

Figure 2:
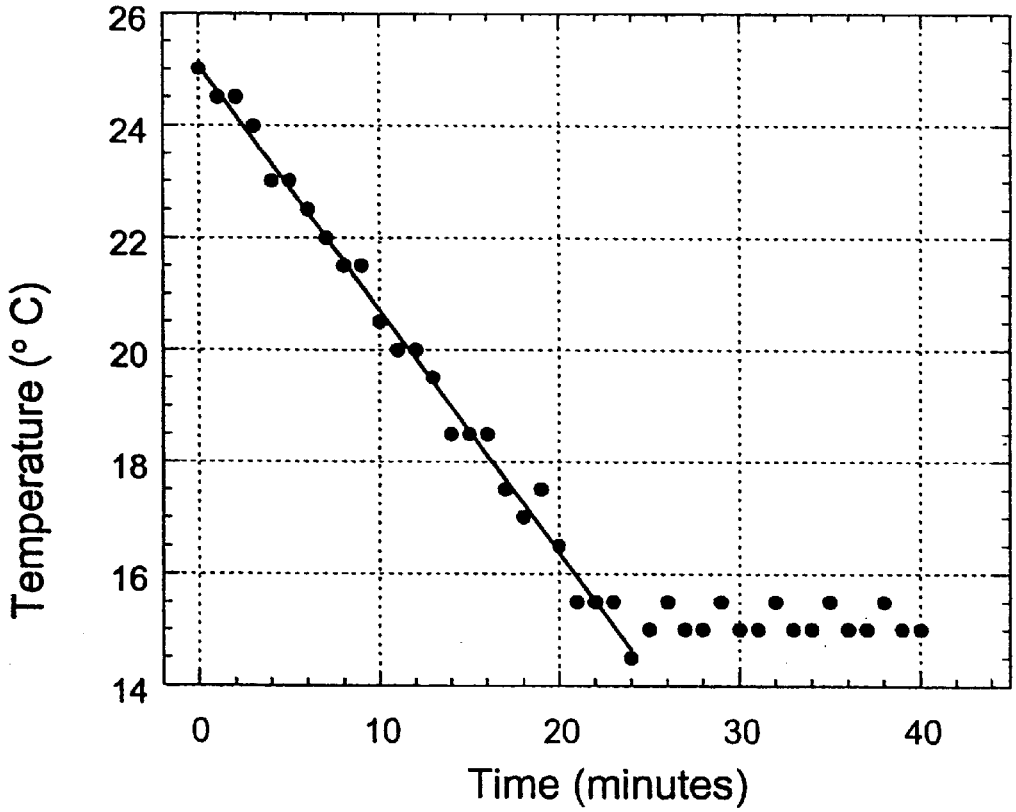
FIG. 2 illustrates an example of a process using the device of Figure.
Figure 3:
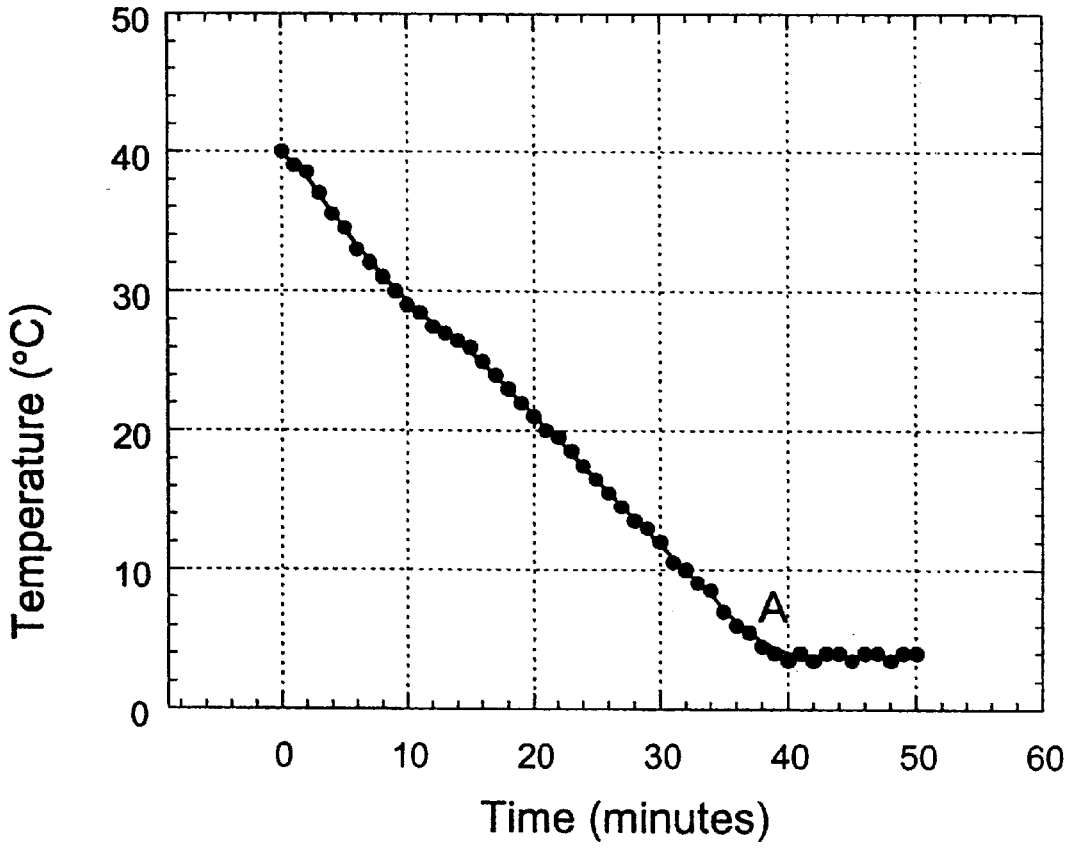
FIG. 3 illustrates a n example of a purification process by re-crystallization of a substance with a device of FIG. 1.

FIG. 2 illustrates an example where a beaker containing 80 ml water, under stirring (250 rpm), has been placed on the device 10 according to the invention. From the graph, it can be concluded that the temperature of said solution has been lowered from 25.0° C. to 15.0° C. with a decrease of the temperature over time of 0.43° C./minute, thereafter kept constant at the latter temperature. FIG. 3 illustrates an example where the start set value has been set at 40° C., the stop set value at 5° C. and the decrease of the temperature over time set at 1° C./minute.

EXAMPLE

This example describes a purification process by re-crystallization of a substance, via aspartic acid, being contaminated with 5% NaCl. Firstly, the contaminated substance (0.33 g) and water (50 ml) is added to a flat bottom beaker (100 ml) and is placed on a device 10 according to the present invention. Thereafter, the temperature of the solution is raised to 40.0° C. and the substance is dissolved under stirring (rpm=250) during 1 hour. Thereafter, a controlled temperature decrease is started with 1° C./minute according to FIG. 3. When the solution has reached the temperature of 5.0° C., see indication A in FIG. 3, small crystals become visible. The temperature of the solution is allowed to stabilize at 4.0° C. and the solution is allowed to stand overnight while stirring (rpm=10). Finally, the solution containing a white precipitate is filtered, the result being a white powder consisting of pure crystals of aspartic acid.

The foregoing description details certain embodiments of the invention and describes the best mode contemplated. Specific parts, shapes, materials, functions and modules have been set forth. However, a skilled technologist will realize that there are many ways to fabricate the system of one embodiment of the invention, and that there are many parts, components, modules or functions that may be substituted for those listed above. While the above detailed description has shown, described, and pointed out fundamental novel features of the invention as applied to various embodiments, it will be understood that various omissions and substitutions and changes in the form and details of the components illustrated may be made by those skilled in the art, without departing from the spirit or essential characteristics of the invention. The scope of the invention should therefore be construed in accordance with the appended Claims and any equivalents thereof.

What is claimed is:

1. A device for controlling the temperature change in a reaction receptacle according to a predetermined scheme, said device comprising:

a reaction receptacle containing a magnetic stirrer;

a heat transfer plate in contact with said reaction receptacle;

means for heating and cooling the reaction receptacle;

means for measuring the temperature of a solution in the reaction receptacle;

a cooling flange comprising a motor, wherein a magnet is attached to said motor such that said magnet influences the magnetic stirrer in the receptacle;

a data processing means for comparing the actual temperature of the solution with a desired temperature and for controlling said means for heating and cooling to heat or cool said solution such that the actual temperature becomes the desired temperature.

2. The device of claim 1, wherein the means for heating or cooling comprises a peltiere element.

3. The device of claim 1, wherein the means for measuring the temperature comprises an internal temperature sensor.

4. The device of claim 1, wherein the means for measuring the temperature comprises an external temperature sensor.

5. The device of claim 1, wherein the data processing means further controls the rate of temperature change of the solution.

6. The device of claim 1, wherein the data processing means further controls a fan.

7. The device of claim 1, wherein the data processing means further controls a motor controlling the number of revolutions of a magnetic stirrer.

8. A device for controlling the temperature change in a reaction receptacle according to a predetermined scheme, said device comprising:

a reaction receptacle containing a magnetic stirrer;

a heat transfer plate in contact with said reaction receptacle;

a peltiere element in contact with said heat transfer plate;

at least one temperature sensor;

a cooling flange comprising a motor, wherein a magnet is attached to said motor such that said magnet influences the magnetic stirrer in the receptacle; and a data processing unit adapted to send out signals to the peltiere element in response to incoming signals from the temperature sensor.

9. The device according to claim 1, wherein said data processing unit further stores information as to the appropriate variation of the temperature over time.

10. The device according to claim 1, wherein said temperature sensor is an internal digital temperature sensor.

11. The device according to claim 1, wherein said temperature sensor is an external temperature sensor immersed in a solution in said receptacle.

12. The device according to claim 1, wherein said data processing unit sends out signals directing the peltiere element to heat or cool the heat transfer plate in response to the incoming signals from the temperature sensor.

13. The device according claim 1, wherein a first side of said peltiere element is in contact with the heat transfer plate and a second side of said peltiere element is in contact with the cooling flange.

14. A method of controlling the temperature in a reaction receptacle using a data processing unit, said method comprising:

entering a desired temperature for a solution in a reaction receptacle;

receiving an input signal from a temperature sensor related to the actual temperature of the solution in the reaction receptacle;

comparing the actual temperature with the desired temperature; and sending a first output signal to a peltiere element if a difference is registered between the actual temperature and the desired temperature, wherein said first output signal causes the peltiere element to heat or cool the solution until the actual temperature is substantially equal to the desired temperature.

15. The method of claim 14, wherein the first signal further controls the rate of temperature change of the solution.

16. The method of claim 15, further including sending a third output signal to a motor controlling the number of revolutions of a magnetic stirrer.

17. The method of claim 14, further including sending a second output signal to a fan.

* * * * *